United States Patent [19]

Brokmann

[11] 4,339,488

[45] Jul. 13, 1982

[54] SUPPORT WEB

[76] Inventor: Manfred Brokmann, Silcherstrasse 5, 4500 Osnabrück, Fed. Rep. of Germany

[21] Appl. No.: 218,818

[22] Filed: Dec. 22, 1980

[30] Foreign Application Priority Data

Dec. 20, 1979 [DE] Fed. Rep. of Germany ..... 2951329

[51] Int. Cl.[3] ..... B32B 3/06; B32B 3/10

[52] U.S. Cl. ..... 428/100; 428/124; 428/138; 428/139; 428/140; 428/157; 428/294; 428/99; 264/273; 297/441; 160/383; 160/404

[58] Field of Search ..... 160/404, 383, 385, 371; 297/441, 457, 218; 428/124, 126, 138, 139, 140, 100, 99, 292, 294, 157; 264/273

[56] References Cited

U.S. PATENT DOCUMENTS

| | | | |
|---|---|---|---|
| 3,375,861 | 4/1968 | Marlow | 160/404 X |
| 3,438,099 | 4/1969 | Green | 160/404 X |
| 3,653,098 | 4/1972 | Lagarde et al. | 264/273 X |

*Primary Examiner*—George F. Lesmes
*Assistant Examiner*—Alexander S. Thomas

[57] ABSTRACT

An improved support web, particularly for use in the construction of furniture, comprises a band, which may be made of plastic material having spaced, parallel, longitudinal reinforcing threads such as glass fibers embedded therein and a connecting member of plastic material at least one end of the band of which is formed in one piece about the band end by a molding or casting process to surround, on all sides, a folded end of the band having its layers secured together, there being holes passing through the folded end of the band which become filled with material of the connecting member. The connecting member has a strong connection with the band and may be nailed or stapled to the frame of a piece of furniture to connect the support web to the frame. Alternatively, the connecting member may be provided with a hook formation or with a molded-in hook or hooks for connecting it to a frame.

12 Claims, 6 Drawing Figures

SUPPORT WEB

FIELD OF THE INVENTION

The present invention relates to a support web, and particularly, although not exclusively, to a support web for use in the construction of furniture, consisting of a flat band member.

Webs of this kind are often used as support webs in general but particularly for composing supports for furniture seats, wherein they form the lower springing for superimposed cushions, or for mattresses in the case of beds, the webs being arranged either in parallel and all in one direction or in parallel and in crossing relationship.

BACKGROUND OF THE INVENTION

Hitherto, in the use of such webs, their attachment to the wooden frame of the chair or bed or other piece of furniture concerned, is accomplished in such a manner that, first, an end region of the web is secured by staples, and then the end of the web is folded over the region of the web, which has already been secured by staples and further staples are then inserted through the web. Only by such a double pinning, which is expensive and complicated, can a connection to the frame be established which can transmit tensile forces in a magnitude which approaches the tensile strength of the web. Nevertheless, the connection always remains a weak point with the frequently observed consequence of detachment or tearing off of the web from the supporting frame.

SUMMARY OF THE INVENTION

The present invention provides a support web comprising a flat band, which may be made of plastic material, having at least at one end a connecting member of plastic material which is formed in one piece about the band end to surround, on all sides, a folded end of the band, having its layers secured together, there being holes passing through the folded end of the web filled with material of the connecting member.

Preferably, the holes are disposed in a row extending transversely of the band, each between an adjacent pair of spaced longitudinal reinforcing threads of glass fiber embedded in the band.

In this way, the reinforcing threads are not severed, and the folded end portion of the band anchors the ends of the reinforcing threads in the connecting member.

A support web according to the present invention can be connected directly and simply, via its connecting member, to any part such as the frame of a piece of furniture, by attachment means such as staples, nails or screws with minimum risk of detachment of the connecting member as a result of tearing out of the staples, nails or screws. The connection between the end of the flat band and the connecting member also has a strength which matches the tensile strength of the support web.

Alternatively, the connecting member may have one or more hooks for connection to the frame.

The layers of band formed at the folded end of the band, because they are secured together have a tensile strength which corresponds at least to that of the single layer portion of the band at the cross-section weakened by the holes. Also, as a result of the fact that the connecting member is formed by casting it or injection-molding it on the end of the band, its material penetrates through the holes so as to unite the two halves of the connecting member through the band, the resulting strength of the anchoring of the end of the band in the connecting member at least lying within the range of the tensile strength of the band, even when, because of the differences between the plastic material selected for the band and for the connecting member, no melting and welding of their contact surfaces takes place during the casting operation to form the connecting member. Such a melting and welding phenomenon is, in any case, not very desirable because it weakens the band itself in the region of the junction between the band and the connecting member.

DETAILED DESCRIPTION

Figure 1:
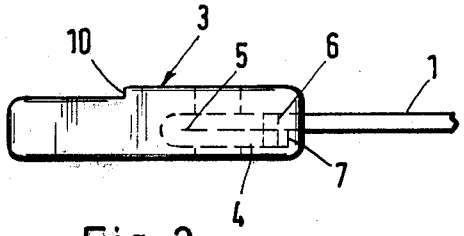
FIG. 1 is a side view of one end region of a support web in accordance with a first embodiment of the present invention.
Figure 2:
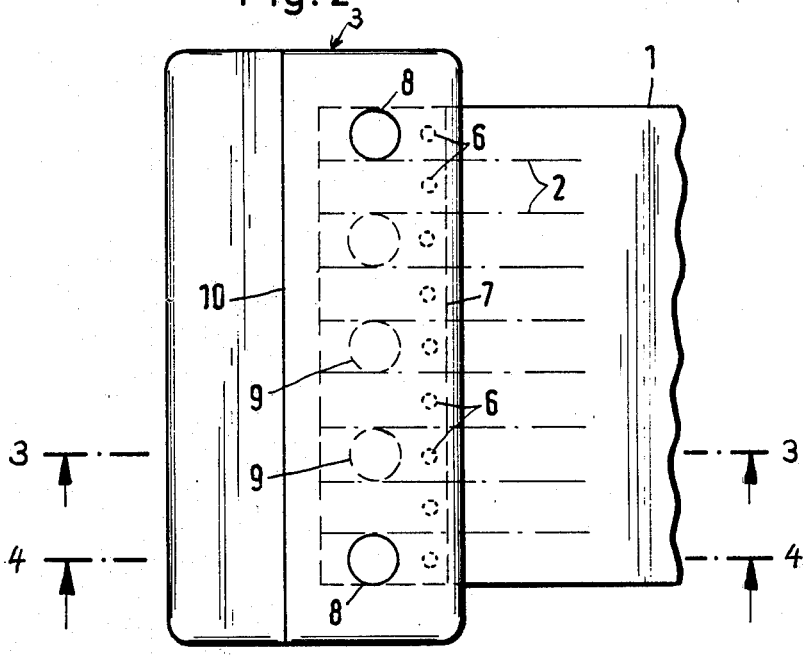
FIG. 2 is a plan view of FIG. 1.
Figure 3:
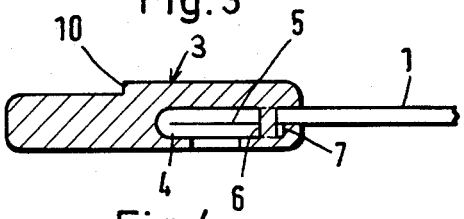
FIG. 3 is a section on line 3—3 in FIG. 2.
Figure 4:
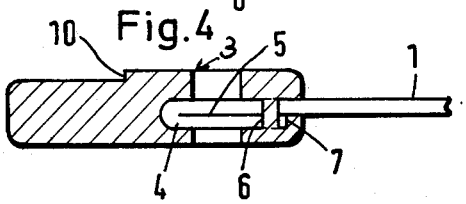
FIG. 4 is a section on the line 4—4 in FIG. 2.

With reference to the accompanying drawings and first to the embodiment of FIGS. 1 to 4, the support web illustrated comprises, in detail, a flat bank 1 of plastic material, for example polyethylene, having longitudinal reinforcing threads 2 of glass fiber embedded therein, the threads 2 being disposed parallel to one another and spaced apart, and a connecting member 3 of plastic material, for example, polypropylene, connected to the band. A particularly rigid plastic material, such as polypropylene, is preferably selected for the connecting member 3 because it is then possible to effect a satisfactory connection of the support web to a frame of a piece of furniture (not illustrated) or any other supporting part, by means of a single suitable staple, nail or screw or by one (or more) connecting hooks.

The bank 1 has a folded end portion 4. This folded end portion 4 of the band is secured by welding of the plastic material of the band to prevent it from unfolding. The welding is preferably carried out over the whole area of the interface 5 between the layers of the band 1 forming its folded end portion 4.

The folded end portion 4 is provided with a transverse row of holes 6 which form casting passages for the flow of material during a casting or injection molding operation to form the connecting member 3 integrally with the band 4, and these holes are filled in by the cast material. The holes 6 are each positioned between an adjacent pair of threads 2 so that all the reinforcing threads 2 remain intact.

This enables the full tensile strength of the support web to be developed and as a result of the folding at the end of the band, the reinforcing threads 2 are also folded, which prevents them from retracting in the plastics material of the band when the support web is under load. In the example illustrated, the holes 6 are disposed close to the end 7 of the band 1 so that the material of the connecting member 3, cast in the holes 6, prevents the splitting of the member 3 in the region where the band 1 enters the connecting member when the support web is placed under load.

In order to save material, recesses 8 and 9 can be formed in the connecting member 3 extending from its upper and its lower surface to the adjacent surface of the band 1. The recesses 8 and 9 may be cylindrical in shape and disposed in a row extending transversely with respect to the longitudinal direction of the support web. The number and size of the recesses 8 and 9 should be selected depending upon the strength of the plastic material selected to compose the connecting member 3. Two recesses 8 or 9 offering themselves at the upper and at the lower surface of the connecting member are convenient from the manufacturing point of view because such recesses can be formed by suitable holding and centering pins in the injection mold.

The connecting member 3 preferably has the shape of a flat plate rounded at its edges. The connecting member 3 conveniently has a step 10 in its upper surface to serve as a stop for a stapling or nailing gun, for example, used to drive one or more staples or nails through the connecting member and into a frame to which the support web is to be connected, the staples or nails being located to the left of the step 10 in FIGS. 1 to 4.

It will be understood that there is considerable room for modifications, particularly in the shape of the connecting member 3, to take account of special applications of a support web according to the present invention. Thus, it is conceivable, for example, to provide the connecting member 3 with a hook-shaped formation extending downwards at an acute angle with respect to the band, by means of which the connecting member 3 can be hooked into a groove in a support part, without any separate fastening means for the connecting member being provided. The hook-shaped formation may extend over the full width of the connecting member.

Figure 5:
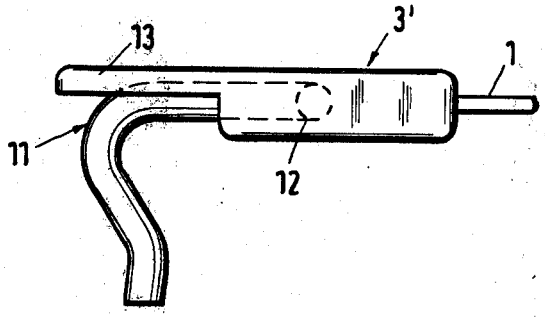
FIGS. 5 and 6 are respectively a side view and a plan view, similar to FIGS. 1 and 2, showing a second embodiment of support web according to the present invention.
Figure 6:
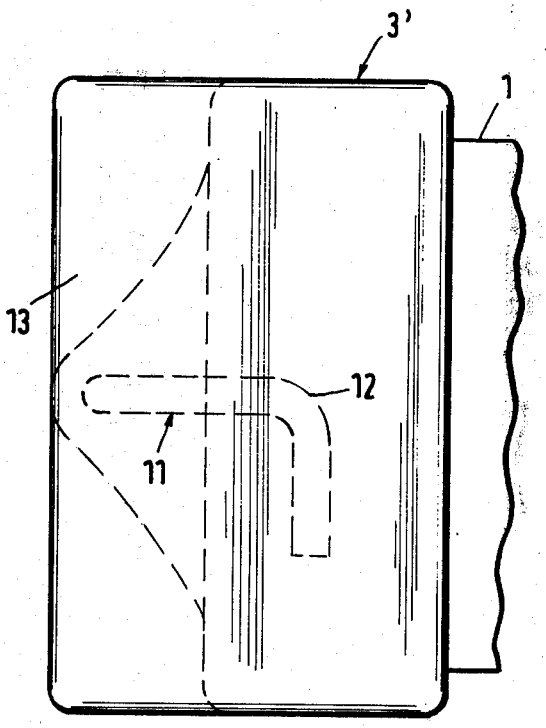

As shown in FIGS. 6 and 5, the connecting member 3' of the support web comprises, at its side remote from the band 1, a connecting hook 11 having an angled anchoring portion 12 molded-in during the injection-molding operation. If necessary, a plurality of the connecting hooks 11 could be used. The hook 11 is engageable in a bore or the like recess in a frame member to connect the support web 1 to the frame.

In the embodiment of FIGS. 5 and 6, the connecting member 3' is further provided with a flange portion 13 which engages over and possibly also locally around the connecting hook or hooks 11 at the upper side. The flange portion 13 can extend over the whole width of the connecting member 3' or it may occupy only a portion of this width, as illustrated in broken lines in FIGS. 5 and 6.

It will be understood that a support web in accordance with the present invention would usually be provided at both ends with a connection member 3 or 3' as described, particularly when it is to be used as a furniture support web, in which case the connecting members 3, 3' favor the mechanical location of the support webs on the frame of the piece of furniture.

It will also be understood that the detailed description of specific embodiments of the present invention given with reference to the drawings is by way of example and not by way of limitation and that the present invention extends to the scope of the following claims.

I claim:

1. A support web comprising a flat band of plastic material having parallel, spaced apart, longitudinally extending reinforcing threads embedded in the band, and, at each end, a connecting member of plastic material formed in one piece about the band end to surround on all sides, a folded end of the band having its layers welded together, there being at least one hole passing through the folded end of the band filled with material of the connecting member, the holes being disposed each between an adjacent pair of the threads.

2. A support web as claimed in claim 1, in which the connecting members are formed with hook formations extending outwardly of the connecting members at the sides thereof remote from the band, the hook formations being disposed to the same side of the band.

3. A support web as claimed in claim 1, in which the holes are disposed in a row extending transversely of the band, each between an adjacent pair of spaced longitudinal reinforcing threads embedded in the band.

4. A support web as claimed in claim 3, in which the reinforcing threads are glass fibers.

5. A support web as claimed in claim 3, in which a hole is provided between each adjacent pair of longitudinal reinforcing threads embedded in the band.

6. A support web as claimed in claim 3, in which the holes are disposed close to the end of the band.

7. A support web as claimed in claim 1, in which recesses are provided in the connecting member extending from its upper and/or lower surfaces to the adjacent surface of the band, the recesses being cylindrical in shape and being disposed in a row transversely with respect to the longitudinal direction of the support web.

8. A support web as claimed in claim 1, in which the connecting member has the shape of a flat plate rounded at its edges.

9. A support web as claimed in claim 1, in which the connecting member has a hook-shaped formation which extends downwards over the full width of the connecting member at an actute angle with respect to the band.

10. A support web as claimed in claim 1, in which the connecting member has a step in its upper surface to act as a stop for a stapling gun or the like fastener driving device.

11. A support web as claimed in claim 1, in which the connecting member has a molded-in connecting hook, which extends outwardly of the connecting member at the side thereof remote from the band.

12. A support web as claimed in claim 11, in which the connecting member has a flange portion engaging over the connecting hook and locally around the hook.

* * * * *